US005878797A

United States Patent [19]

Manuel et al.

[11] Patent Number: 5,878,797

[45] Date of Patent: Mar. 9, 1999

[54] VENT TUBE

[75] Inventors: John F. Manuel, Ramsey, N.J.; Alexander F. Clarino, Hawthorne; Vincent S. Caliendo, East Meadow, both of N.Y.

[73] Assignee: The Coca-Cola Company, Atlanta, Ga.

[21] Appl. No.: 858,474

[22] Filed: May 20, 1997

[51] Int. Cl.[6] ..... B65B 3/18

[52] U.S. Cl. ..... 141/286; 141/59

[58] Field of Search ..... 141/40, 39, 59, 141/290, 286, 65, 329

[56] References Cited

U.S. PATENT DOCUMENTS

| | | | |
|---|---|---|---|
| 1,290,656 | 1/1919 | Price | 141/286 |
| 2,063,326 | 12/1936 | Meyer | 141/39 |
| 2,364,400 | 12/1944 | Stewart et al. | 141/59 |
| 2,536,746 | 1/1951 | Hollifield | 141/39 |
| 2,896,674 | 7/1959 | Day et al. | 141/39 |
| 3,736,966 | 6/1973 | Dichiara | 141/37 |
| 3,774,658 | 11/1973 | Abramoska, Jr. | 141/286 |
| 3,834,428 | 9/1974 | Rademacher | 141/39 |
| 3,845,791 | 11/1974 | Friendship | 141/6 |
| 4,049,030 | 9/1977 | Abramoska, Jr. | 141/286 |
| 4,363,339 | 12/1982 | Puskarz | 141/39 |
| 4,398,575 | 8/1983 | Brandon | 141/39 |
| 4,589,453 | 5/1986 | Weiss | 141/39 |
| 4,665,957 | 5/1987 | Suzuki et al. | 141/39 |
| 4,745,730 | 5/1988 | Bartle, Sr. | 141/65 X |
| 4,749,010 | 6/1988 | Petell | 141/59 |
| 4,949,764 | 8/1990 | Clusserath | 141/6 |
| 5,031,785 | 7/1991 | Lemme | 141/65 X |
| 5,040,574 | 8/1991 | Petri et al. | 141/39 |
| 5,145,008 | 9/1992 | Yun | 141/39 |
| 5,156,200 | 10/1992 | Mette | 141/46 |
| 5,209,274 | 5/1993 | La Warre, Sr. | 141/39 |
| 5,220,946 | 6/1993 | Murao et al. | 141/6 |
| 5,226,463 | 7/1993 | Mette et al. | 141/39 |
| 5,313,990 | 5/1994 | Clusserath | 141/6 |
| 5,339,874 | 8/1994 | Cragun | 141/9 |
| 5,372,167 | 12/1994 | Hirose et al. | 141/39 |
| 5,474,112 | 12/1995 | Carola | 141/7 |

*Primary Examiner*—Henry J. Recla
*Assistant Examiner*—Kathleen J. Prunner
*Attorney, Agent, or Firm*—Kenyon & Kenyon

[57] ABSTRACT

A vent tube for a filling apparatus comprises a tube extending from an upper end which is selectively coupleable to the apparatus, to a lower end forming a fill tip, wherein the fill tip includes at least one opening formed therethrough to fluidly couple an atmosphere surrounding the fill tip to the lumen and a spreader having an upper surface extending a predetermined distance from a portion of the tube above the fill tip in a plane substantially perpendicular to an axis of the tube. A tapered bottle guide extends from the tube between the fill tip and the spreader, so that a diameter of the bottle guide increases from a minimum diameter at a lower end thereof to a maximum diameter at an upper surface thereof, wherein the upper surface of the bottle guide abuts a lower surface of the spreader.

23 Claims, 3 Drawing Sheets

VENT TUBE

FIELD OF THE INVENTION

The present invention relates to vent tubes for use in machines for filling liquid into containers.

BACKGROUND OF THE INVENTION

Machines for filling liquid into containers (fillers), such as bottles and/or cans, are known which include a rotating assembly having a plurality of filling stations each of which receives a single container. Each bottle is initially received on a base which, as the assembly rotates, is moved upward so that a vent tube extending downward from the filling station is received in the bottle. This vent tube serves several purposes. First, the vent tube aids in centering the bottle so that it is received in the filling station in a desired orientation. In addition, as liquid is filled, the vent tube vents gas from the bottle, sets the height to which liquid is filled in the bottle and modifies the flow pattern of the liquid being filled into the bottle.

To achieve these goals, known vent tubes have included a central hollow tube extending from a lower, tapered, fill tip upward to a filling valve. Between the filling valve and the fill tip, a spreader in the form of a projecting disc extends from the outside of the vent tube to divert the flow path of liquid flowing down the outside of the vent tube so that the liquid flows down the sides of the bottle. This allows much higher filling speeds than could be obtained if the liquid were filled straight into the bottle.

However, increased filling speeds have increased the severity and frequency of problems caused when the bottles improperly receive the vent tubes. If on entering the filling station, the bottle is misaligned with respect to the vent tube, contact between the bottle neck and the spreader can cause the bottle to be crushed as the base raises the bottle toward the filling valve. This can cause jams which, at high speeds, can result in jams which require that the production line be shut down, decreasing efficiency and requiring the services of one or more technicians to remedy the problem. In addition, such jams can result in the destruction of the filling valve at the effected filling station. This valve, which is an expensive part, must then be replaced. Replacing the valve is difficult and time consuming and requires the emptying of the liquid from the filler, further increasing the costs associated with the jam.

Alternatively, contact between the spreader and the bottle can result in damage to the upper surface of the bottle neck. This can impair the sealing of the bottle causing problems such as, for example, loss of carbonation of the product. This, in turn, results in a decrease in the shelf-life of the product.

In order to reduce contact between bottles and the spreader, a vent tube 10, as shown in FIG. 1, is known in which the fill tip 12 has been extended outward so that a maximum diameter of the fill tip 12 is equal to or greater than a maximum diameter of the spreader 14. However, although this fill tip 12 has reduced problems associated with contact between the bottle and the spreader 14, a new problem has arisen in the filling of carbonated products. Due to the increased diameter, a vacuum is drawn when the fill tip 12 is removed through the neck of the bottle, adversely effecting the carbonation of the product, thereby decreasing product shelf life.

As shown in FIG. 2A, a vent tube 10' is known which includes a bottle guide 20 positioned between the fill tip 12 and the spreader 14. The diameter of the bottle guide 20 gradually increases from a minimum diameter at the lowermost portion thereof to a maximum diameter after which the diameter decreases to the diameter of the vent tube 10'. The portion of the vent tube 10' above the bottle guide 20 includes a threaded portion 22 with a first locking nut 24 received below the spreader 14 and a second locking nut 24' positioned above the spreader 14 on a second threaded portion 23. The locking nuts 24 and 24' maintain the spreader 14 in a desired position and allow this position to be adjusted by moving the locking nuts up or down on the threaded portion 22. Similarly, locking nut 21 is received on a third threaded portion 27 above for adjusting the position of the fill tip 12, while locking nuts 25 and 25' are received on threaded portions 27 and 22, respectively for adjusting the position of the bottle guide 20. Thus, such vent tubes 10' may be adapted for use with various bottle sizes and shapes by moving the spreader 14, the bottle guide 20 and the fill tip 12 to desired locations relative one another and to the filling valve.

However, adjusting the height of the spreader 14 requires that an operator grip one of the locking nuts 24, 24' by inserting a tool over the locking nut and rotating the locking nut until the spreader 14 has reached the desired position. The other locking nut is then rotated to tighten the spreader 14 in the desired position. However, this operation can loosen the vent tube 10' which is screwed into the filling station at the threaded portion 29. This can require further tightening of the vent tube using a tool to turn one of the locking nuts which may move the spreader 14 out of the desired position. The position of the spreader 14 is critical to filling efficiency and differences in the height of the spreader 14 of 1/16" or less can adversely effect the filling speed. Thus, this type of vent tube 10' is susceptible to improper vent tube positioning, reducing efficiency and requires a significant effort on the part of the technician to replace and/or adjust the tubes to adapt a filler to accept a new size or shape of bottle. Similarly, improper positioning of the fill tip and the consequent inaccuracy of the fill height may lead to consumer complaints and may also result in violations of consumer protection laws.

Finally as shown in FIG. 2B, a vent tube 10" similar in shape to the vent tube 10' is known which has addressed the problems associated with the adjustable height spreader tubes 10' by including an open tip 11, bottle guide 20 and spreader 14 integrally formed with the vent tube. This vent tube is snap fit into the filling station eliminating the need to use tools to tighten the vent tube into the filling station and ensuring proper spreader placement. Thus, instead of adjusting the relative position of the spreader and the fill tip to accommodate different bottle sizes and shapes, users of this vent tube simply exchange the old vent tubes for a new set specifically adapted for the new type of bottle.

However, both the vent tube 10' and the above-described vent tube with the integrally formed spreader suffer from all of the problems associated with contact between the bottle and the spreader 14. The bottle guide 20 reduced but has not eliminated these problems. Especially at higher filling speeds (up to 1,000 bottles a minute), these problems persist and the resulting jams are more serious and costly. Specifically, when a bottle enters a filling station out of the proper alignment, the neck of the bottle may slide past the bottle guide 20 to abut the under side of the spreader 14. Then, as the bottle is raised through the camming action of the filler, the neck of the bottle may be crushed. This crushed bottle will likely cause a jam—for example, during transfer from the filler to the next processing station.

SUMMARY OF THE INVENTION

The present invention is directed to a vent tube for a filling apparatus for automatically filling liquid into containers comprising a tube having a lumen extending therethrough. The tube extends from an upper end which is selectively coupleable to the apparatus, to a lower end forming a fill tip including at least one opening formed therethrough to fluidly couple an atmosphere surrounding the fill tip to the lumen. The vent tube also includes a spreader having an upper surface extending a predetermined distance from a portion of the tube above the fill tip in a plane substantially perpendicular to an axis of the tube and a bottle guide extending from the tube between the fill tip and the spreader. The bottle guide is tapered so that a diameter of the bottle guide increases from a minimum diameter at a lower end thereof to a maximum diameter at an upper surface thereof with the upper surface of the bottle guide abutting a lower surface of the spreader.

DETAILED DESCRIPTION

Figure 2A:
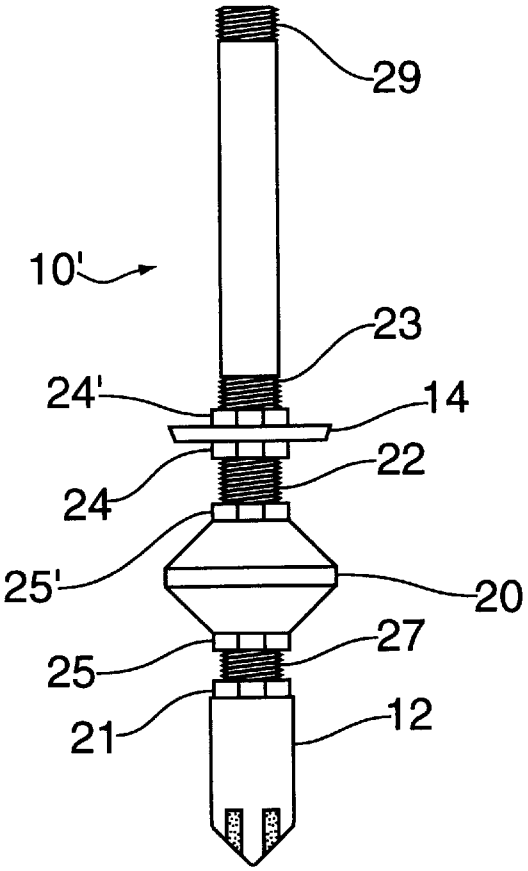
FIG. 2A PRIOR ART
FIG. 2A is a side view of a second prior art vent tube.
Figure 1:
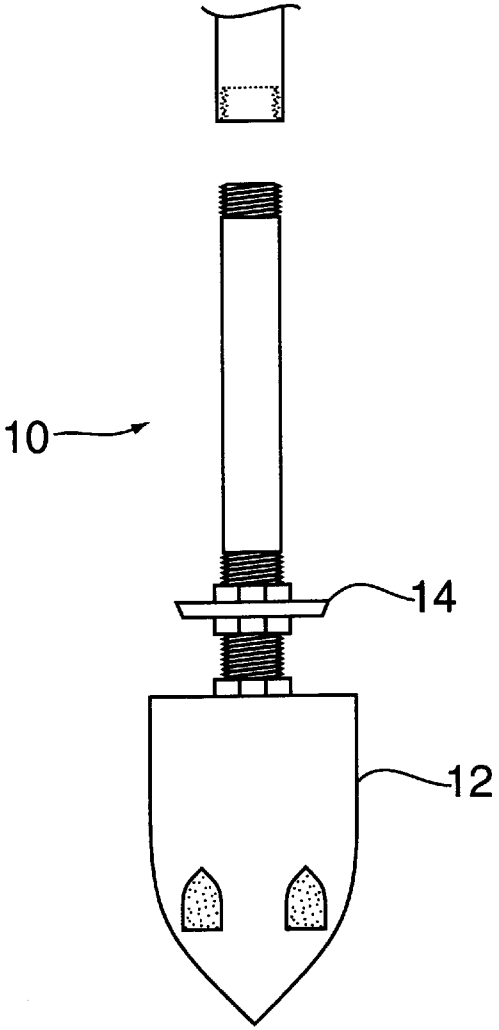
FIG. 1 PRIOR ART
FIG. 1 is a side view of a first prior art vent tube.
Figure 3:
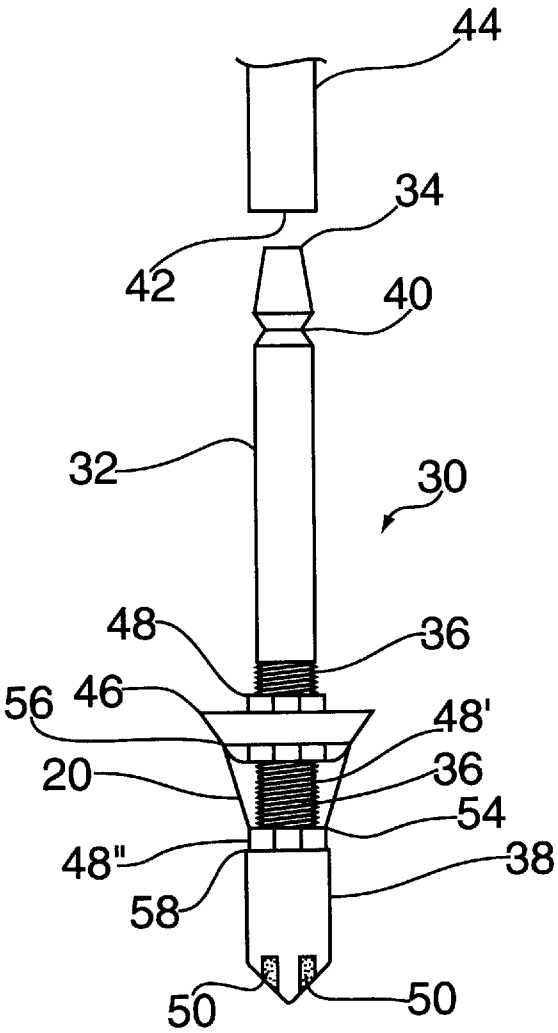
FIG. 3 is a side view of a vent tube according to a first embodiment of the invention.
Figure 2B:
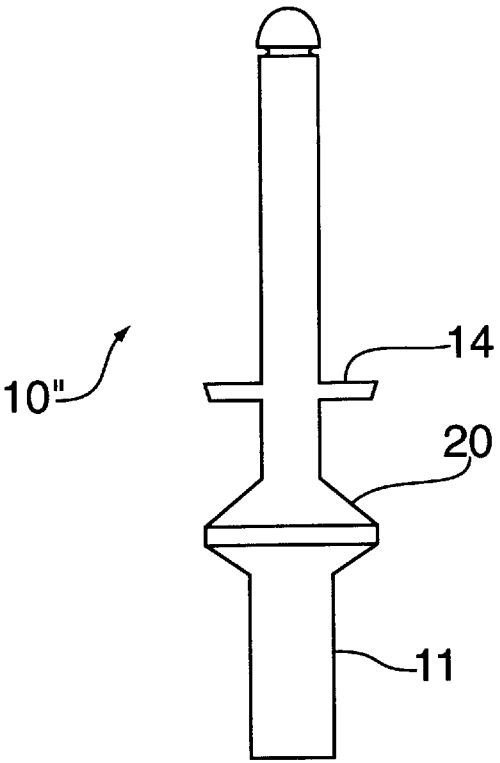
FIG. 2B PRIOR ART
FIG. 2B is a side view of a third prior art vent tube.

As shown in FIG. 3, the vent tube 30 according to the first embodiment of the present invention may include a central pipe 32 which extends from an upper end 34 through a central threaded portion 36 to a lower end received within the fill tip 38. A circular groove 40 encircling the pipe 32 near the upper end 34 is adapted to receive a corresponding annular projection 42 formed around an inner surface of a circular receptacle 44 mounted on a filler (not shown). The vent tube 30 includes a spreader 46 which is held in a desired position on the pipe 32 by means of locking nuts 48 and 48' which are received on the threaded portion 36. Below the locking nut 48' is a third locking nut 48" which maintains the fill tip 38 in a desired position relative to the spreader 46. Of course, those skilled in the art will understand that a vent tube according to the present invention may be coupled to the filling station by any known coupling such as a second threaded portion at the upper end 34 of the pipe 32 which would mate with a corresponding threaded portion of the cylindrical receptacle 44.

The fill tip 38 includes at least one (in this case, at least 2) openings 50 which, when the vent tube 30 is received within a bottle, fluidly couple the atmosphere within the bottle to a pressure control apparatus (not shown) in the filler or to the ambient atmosphere via a central lumen (not shown) within the pipe 32 to prevent excessive pressure from building up within the bottle during filling. When the liquid filled into the bottle completely covers the openings 50, filling is automatically stopped, as is known in the art. Thus, the position of the openings 50 controls the height to which liquid is filled into the bottles.

Thus, in known fillers using adjustable vent pipes, when it is desired to reconfigure the filler to receive bottles of different size or shape, the height of both the spreader and the openings must be adjusted for every filling station. As described above, this requires a considerable amount of down-time for the production line and consumes significant effort on the part of skilled technicians. However, the vent pipes according to the present invention are not adjusted while coupled to the filler to accommodate different bottle types. The tubes currently in place are simply snapped out of the receptacles 44 and replaced with a new set of vent tubes configured for the new bottles. This process can be done by hand with no tools.

Thus, the vent tube 30 according to the first embodiment of the present invention may be either permanently configured for a particular bottle size and shape or, may be snapped out of the filler and replaced with a new set of vent tubes 30, allowing the removed vent tubes 30 to be reconfigured for the next type of bottle to be processed. This reduces down-time for the line. That is, the snap fit of vent tubes 30 allows them to be placed without the gripping and twisting of any locking nuts which might result in improper alignment of the spreader 46 and/or the fill tip 38. Therefore, adjustment of the spreader 46 after insertion of the vent tube 30 into the filler is not required.

In addition, the vent tube 30 according to the first embodiment of the invention includes a bottle guide 20 received around the pipe 32 and extending from the spreader 46 down to an upper end of the locking nut 48". The diameter of the bottle guide 20 increases from a minimum at a lower end 54 adjacent to the locking nut 48" to a maximum at an upper end 56 which abuts a lower surface of the spreader 46. The minimum diameter of the bottle guide 20 is substantially equal to the diameter of the locking nut 48" while the maximum diameter is substantially equal to the diameter of the lower end of the spreader 46. Thus, the effective outer diameter of the vent tube 30 is gradually increased by the tapered outer surface of the bottle guide 20 and the complimentarily tapered outer surface of the spreader 46. Of course, those skilled in the art will understand that the minimum diameter of the bottle guide 20 may be equal to or less than a diameter of an upper end 58 of the fill tip 38 so that, when the fill tip 38 is received within a bottle, the upper edge of the neck of the bottle runs along the surface of the vent tube 30 all the way to the spreader 46 without running into a shoulder or other surface which might prevent the vent tube 30 from smoothly entering the bottle.

Figure 4:
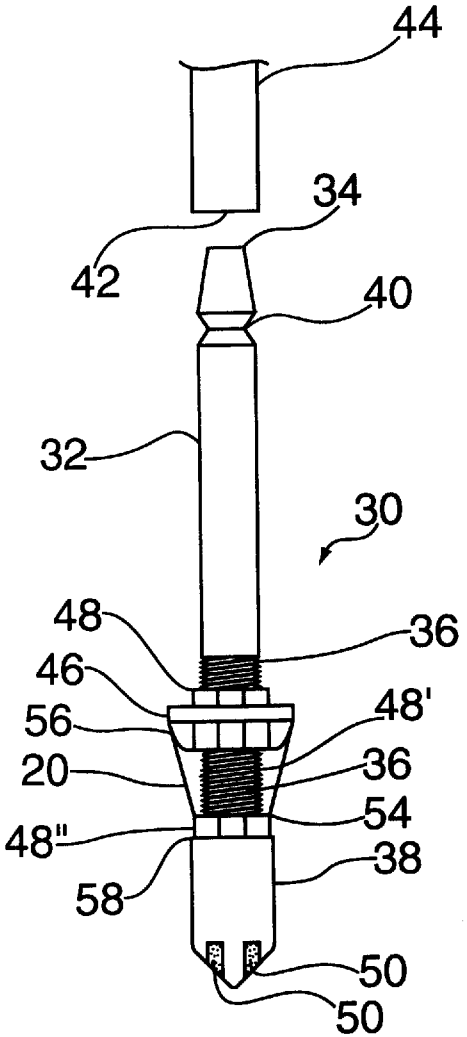
FIG. 4 a side view of a vent tube according to a second embodiment of the invention.

As shown in FIG. 3, the bottle guide 20 is preferably formed as a portion of a cone having a base angle which is between 20° and 60° and which is more preferably between 35° and 45°—most preferably approximately 36.° The spreader may comprise a portion of the cone which makes up the bottle guide 20 so that an outer surface of the bottle guide 20 and an outer surface of the spreader 14 make up one continuous surface or, as shown in FIG. 4, the spreader may simply be formed as a disc sitting atop the bottle guide 20 wherein a maximum diameter of the disc spreader 14 is less than or equal to the maximum diameter of the bottle guide 20.

The pipe 32 may preferably be formed of stainless steel or other metal which is not consumable by acids or rust as is known in the art while the bottle guide 20, the spreader 46 and the fill tip 38 may be formed of a metal such as stainless steel or a plastic or Teflon material. Those skilled in the art will recognize that, for vent tubes 30 permanently configured for a particular bottle, the use of a plastic or Teflon material for the fill tip 38 for example, allows the color of the fill tip 38 to identify the particular bottle for which the vent tube 30 is configured.

Figure 6:
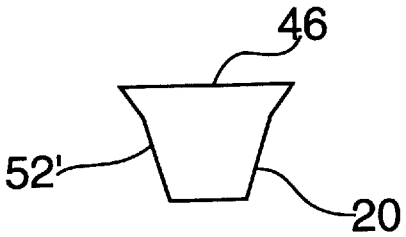
FIG. 6 is a side view of a spreader and bottle guide according to a fourth embodiment of the invention.
Figure 5:
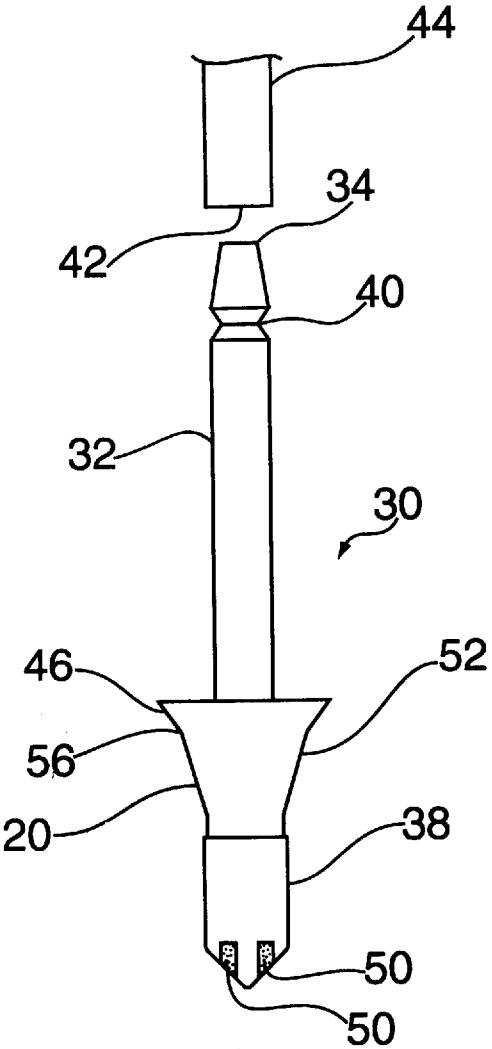
FIG. 5 is a side view of a vent tube according to a third embodiment of the invention.

Of course, as shown in FIG. 5, the vent tube 30 may alternatively include a bottle guide 20 and a spreader 46 which are integrally formed with the pipe 32. As will be understood by those skilled in the art, the contour of the outer surfaces of the bottle guide 20 and the spreader 46 may be formed in any shape which will allow the vent tube 30 to be smoothly inserted into the bottle necks. For example, an integrally formed spreader 46 and bottle guide 20 are shown in FIG. 6 with a curved outer surface 52'.

Those skilled in the art will understand that, although the invention has been described in conjunction with a bottle filling operation, that the same principles may be applied to a vent tube for the filling of cans or other containers. Many modifications of this invention will be apparent to those skilled in the art and it is understood that these modifications are within the teaching of this invention which is to be limited only by the claims appended hereto.

What we claim is:

1. A vent tube for a filling apparatus for automatically filling liquid into containers comprising:

a tube defining a lumen extending therethrough, the tube extending from an upper end, which is selectively coupleable to the apparatus, to a lower end forming a fill tip, wherein the fill tip includes at least one opening formed therethrough to fluidly couple an atmosphere surrounding the fill tip to the lumen;

a spreader for diverting laterally a flow of the liquid passing along an outer surface of the tube, the spreader having an upper surface extending a predetermined distance from a portion of the tube above the fill tip in a plane substantially perpendicular to an axis of the tube; and a bottle guide extending from the tube between the fill tip and the spreader, wherein the bottle guide is tapered so that a diameter of bottle guide increases from a minimum diameter at a lower end thereof to a maximum diameter at an upper surface thereof, said minimum diameter being equal to or less than an outermost diameter of the fill tip and wherein the upper surface of the bottle guide abuts a lower surface of the speader;

wherein, when the tube is coupled to the filling apparatus, the spreader and the fill tip are immovably positioned a predetermined distance from one another and wherein an outer surface of the tube from its fill tip to the spreader is smooth and free of shoulders or other surface characteristics which would prevent the tube from smoothly entering the containers being filled.

2. The vent tube according to claim 1, wherein the bottle guide is formed as a portion of a cone centered about the axis of the tube.

3. The vent tube according to claim 2, wherein a base angle of the cone of which the bottle guide forms a portion, is between 20° and 60°.

4. The vent tube according to claim 2, wherein a base angle of the cone of which the bottle guide forms a portion, is between 35° and 45°.

5. The vent tube according to claim 1, wherein the spreader is formed as a disc with a diameter substantially equal to the maximum diameter of the bottle guide.

6. The vent tube according to claim 1, wherein the tube, bottle guide and spreader are integrally formed.

7. The vent tube according to claim 1, wherein the tube includes an upper portion configured so as to be locked into the filling apparatus so that the spreader and fill tip are secured in desired positions with respect to the filling apparatus.

8. The vent tube according to claim 7, wherein the upper portion of the tube includes a circumferential groove which is adapted to receive therein a circular protrusion extending around an inner circumference of a mating portion of the filling apparatus so that the tube may be snap-fit into the filling apparatus.

9. The vent tube according to claim 1, wherein the fill tip is formed of one of a plastic material and Teflon.

10. The vent tube according to claim 9, wherein the fill tip is colored coded to provide a visual indication of an operational characteristic of the tube.

11. The vent tube according to claim 1, wherein the bottle guide is formed as a portion of a cone having a maximum diameter at the upper surface thereof with the upper surface of the bottle guide contacting the lower surface of the spreader and wherein the maximum diameter of the bottle guide is at least as great as a maximum diameter of the spreader.

12. The vent tube according to claim 11, wherein a base angle of the cone of which the bottle guide forms a portion, is between 35° and 45°.

13. A vent tube for a filling apparatus for filling liquid into containers comprising:

a pipe extending from an upper portion which is selectively coupleable to the filling apparatus to a lower portion, wherein a lumen extends through the pipe from the upper portion to an opening formed in the lower portion;

a spreader for diverting laterally a flow of the liquid passing along an outer surface of the pipe, the spreader an upper surface of which extends from the outer surface of the pipe in a plane substantially perpendicular to an axis of the pipe, wherein a distance by which the upper surface of the spreader extends from the outer surface of the pipe is a maximum distance by which the spreader extends from the outer surface of the pipe;

a guide member extending from the outer surface of the pipe so that an upper end thereof abuts a lower surface of the spreader, wherein an extension from the outer surface of the pipe of the upper end is at least as great as an extension of the lower surface of the spreader from the outer surface of the pipe, so that an outer surface of the vent tube tapers gradually from a minimum diameter at a lower end of the guide member to a maximum diameter at the upper surface of the spreader said minimum diameter being equal to or less than an outermost diameter of the pipe, and wherein the outer surface of the pipe from its opening formed in the lower portion to the spreader is smooth and free of shoulders or other surface characteristics which would prevent the vent tube from smoothly entering the containers being filled.

14. The vent tube according to claim 13, wherein the guide member is formed as a portion of a cone with a central axis coincident with the axis of the pipe and wherein the upper surface of the spreader is formed as a disc centered on the axis of the pipe.

15. The vent tube according to claim 14, wherein a base angle of the cone of which the guide member forms a portion, is between 20° and 60°.

16. The vent tube according to claim 14, wherein a base angle of the cone of which the guide member forms a portion, is between 35° and 45°.

17. The vent tube according to claim 13, wherein the pipe, guide member and spreader are integrally formed.

18. The vent tube according to claim 13, further comprising a fill tip formed at the lower portion of the pipe, wherein the fill tip includes at least one hole formed therethrough so that the lumen is fluidly coupled to the atmosphere surrounding an outer surface of the fill tip.

19. The vent tube according to claim 18, wherein a lower portion of the fill tip is tapered.

20. The vent tube according to claim 18, wherein the fill tip is formed of one of a plastic material and Teflon.

21. The vent tube according to claim 20, wherein the fill tip is colored coded to provide a visual indication of an operational characteristic of the pipe.

22. The vent tube according to claim 13, wherein the upper portion of the pipe is configured so as to be locked into the filling apparatus so that the spreader is secured in a desired position with respect to the filling apparatus.

23. The vent tube according to claim 22, wherein the upper portion of the pipe includes a circumferential groove which is adapted to receive therein a circular protrusion extending around an inner circumference of a mating portion of the filling apparatus so that the pipe may be snap-fit into the filling apparatus.

* * * * *

UNITED STATES PATENT AND TRADEMARK OFFICE

CERTIFICATE OF CORRECTION

PATENT NO. : 5,878,797
DATED : March 9, 1999
INVENTOR(S) : Manuel et al

It is certified that error appears in the above-identified patent and that said Letters Patent is hereby corrected as shown below:

Column 5, line 36 "of bottle guide" should be changed to – of the bottle guide –;

Column 6, line 11 "colored coded" should be changed to – color coded –;

Column 6, line 46 "spreader said" should be changed to – spreader, said –; and

Column 7, line 9 "color coded" should be changed to – color coded –.

Signed and Sealed this

Twenty-sixth Day of December, 2000

*Attest:*

Q. TODD DICKINSON

*Attesting Officer*

*Director of Patents and Trademarks*